United States Patent [19]

Egnell et al.

[11] 4,277,942

[45] Jul. 14, 1981

[54] EXHAUST GAS RECIRCULATION APPARATUS

[75] Inventors: Rolf A. Egnell, Genarp; Bengt L. Hansson, Bjärred, both of Sweden

[73] Assignee: Kommanditbolaget United Stirling, Malmo, Sweden

[21] Appl. No.: 16,079

[22] Filed: Feb. 28, 1979

[51] Int. Cl.[3] ..... F02G 1/04; F23C 9/02

[52] U.S. Cl. ..... 60/517; 431/116

[58] Field of Search ..... 60/517, 650, 682, 643, 60/645; 431/115, 116

[56] References Cited

U.S. PATENT DOCUMENTS

| | | | |
|---|---|---|---|
| 3,754,393 | 8/1973 | Handa | 431/116 X |
| 3,851,467 | 12/1974 | Sherman et al. | 431/116 X |
| 3,918,262 | 11/1975 | Postma | 60/517 |
| 3,935,708 | 2/1976 | Harrewijne et al. | 60/517 |
| 3,969,892 | 7/1976 | Stettler et al. | 431/116 X |

*Primary Examiner*—Allen M. Ostrager

*Attorney, Agent, or Firm*—Finnegan, Henderson, Farabow, Garrett & Dunner

[57] ABSTRACT

Apparatus for recirculating combustion exhaust gases to the burner region of a Stirling cycle hot-gas engine to lower combustion temperature and reduct $NO_x$ formation includes a first wall separating the exhaust gas stream from the inlet air stream, a second wall separating the exhaust gas stream from the burner region, and low flow resistance ejectors formed in the first and second walls for admitting the inlet air to the burner region and for entraining and mixing with the inlet air portion of the exhaust gas stream. In a preferred embodiment the ejectors are arranged around the periphery of a cylindrical burner region and oriented to admit the air/exhaust gas mixture tangentially to promote mixing. In another preferred embodiment a single annular ejector surrounds and feeds the air/exhaust gas mixture to a cylindrical burner region. The annular ejector includes an annular plate with radially-directed flow passages to provide an even distribution of the air/exhaust gas mixture to the burner region.

22 Claims, 6 Drawing Figures

EXHAUST GAS RECIRCULATION APPARATUS

BACKGROUND OF THE INVENTION

1. Field of the Invention

This invention relates to an apparatus for recirculating combustion exhaust gases to the burner region of a combustion device for lowering combustion temperatures and reducing the formation of nitrogen oxides ($NO_x$).

2. Description of the Prior Art

It is generally known that, if formation of nitrogen oxides ($NO_x$) is to be kept at a low level, high temperatures during combustion should be avoided if air is used as the oxidizing medium. It is also known that exhaust gas recirculation is an effective method of lowering peak temperatures during the combustion process and thus minimizing the formation of $NO_x$. This principle has been utilized in the design of engines depending upon the combustion process for their energy source, including hot gas engines utilizing the Stirling cycle. The U.S. Pat. Nos. 3,456,438 to R. J. Meijer et al. and 3,546,876 to H. Fokker et al. show Stirling cycle applications utilizing combustion gas recirculation for controlling combustion temperatures and $NO_x$ formation.

The major drawbacks of exhaust gas recirculation are the costs of the necessary special components to achieve recirculation, the decrease in overall efficiency because of the additional hydraulic flow losses occuring in the recirculation apparatus, and the maintenance costs for the additional apparatus. In the known devices for utilizing exhaust gas recirculation in conjunction with hot-gas engine operation, the exhaust gases are mixed with the inlet air prior to the air being admitted to the combustion region. This mixing can be accomplished after the inlet air has exited the preheater apparatus in order to reduce the volume of gases flowing through the preheater and thus minimize hydraulic losses in that component. However, the hydraulic losses which occur in these known exhaust recirculation devices are still large and degrade the overall performance of the engines.

One of the major shortcomings of existing prior art exhaust recirculation devices is that the recirculation is accomplished outside the general vicinity of the burner region of the combustion device, necessitating additional conduits and external mixing devices such as a fan or an externally mounted ejector. The present invention eliminates the need to externally mount these components and thereby achieves a significant reduction in the length of conduits needed to carry the recirculated exhaust gases and thereby effects a reduction in the consequent hydraulic flow losses.

SUMMARY OF THE INVENTION

The present invention overcomes the problems and disadvantages of the prior art recirculation apparatus by providing apparatus having low flow resistance and requiring minimum maintenance intimately associated with the burner region. The recirculation apparatus of the present invention also is easily fabricated and, therefore, does not add appreciably to the capital cost of the overall combustion device.

To achieve the objects and in accordance with the invention, as embodied and broadly described herein, the apparatus for recirculating a portion of the exhaust gases from the exhaust gas stream resulting from the combustion of an inlet fuel stream and an inlet air stream in a burner region, comprises wall means for separating the inlet air stream from the burner region and the exhaust gas stream; and ejector means formed in the wall means for admitting the inlet air stream into the burner region and for entraining and mixing a portion of the exhaust gases from the exhaust gas stream into the air being admitted, the air/exhaust gas mixture being formed immediately prior to being admitted to the burner region, the recirculated exhaust gases providing lower combustion temperatures and reduced $NO_x$ formation in the burner region Preferably, the wall means includes a first wall separating the inlet air stream from the exhaust gas stream and the burner region, and a second wall separating the exhaust gas stream from the burner region; and the ejector means includes inlet nozzle means in flow commmunication with the inlet air stream, outlet nozzle means in flow communication with the burner region, and suction inlet means in flow communication with the exhaust gas stream and cooperating with the inlet nozzle means and the outlet nozzle means, the inlet nozzle means being formed in the first wall, and the outlet nozzle means formed in the second wall.

The accompanying drawings, which are incorporated in and constitute a part of this specification, illustrate two embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
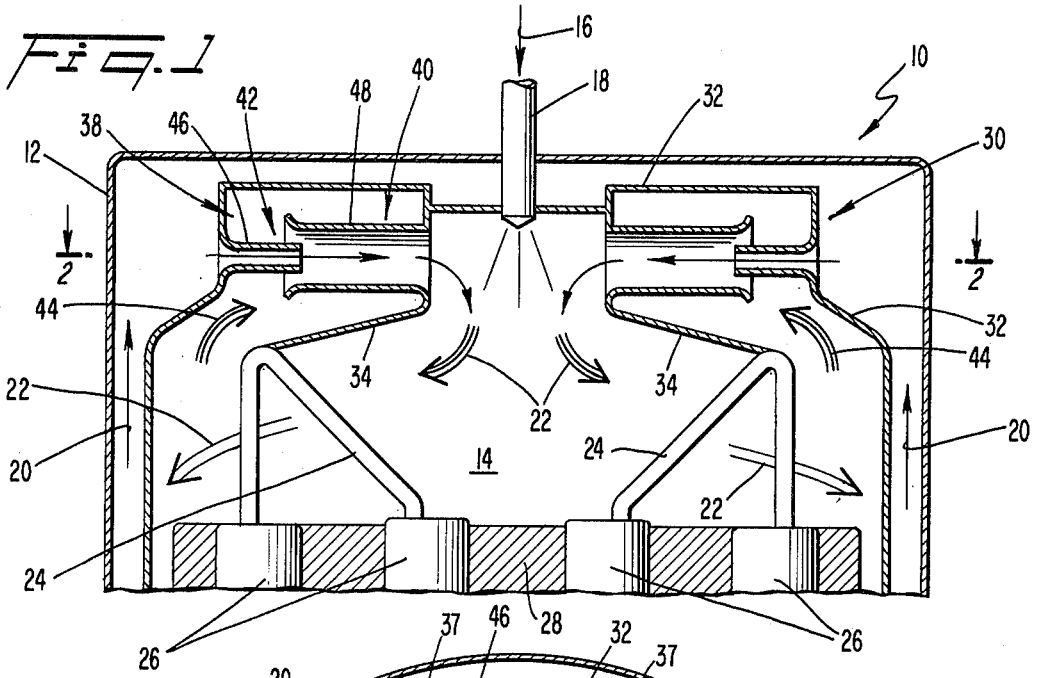
FIG. 1 is a schematic representation of a cross-sectional side view of one embodiment of the present invention.

A preferred embodiment of the recirculation apparatus of the present invention, represented generally by the numeral 10 in FIG. 1, is shown being used in conjunction with a hot-gas engine 12 of the Stirling cycle type. Stirling engine 12 includes a generally cylindrical burner region 14 for combusting a fuel with air. The fuel is introduced to burner region 14 from fuel stream 16 through fuel nozzle means such as fuel nozzle 18, positioned to introduce the fuel axially to the cylindrical burner region 14. Air for combustion is supplied from inlet air stream 20 (shown as single arrows in the Figures). Inlet air stream 20 preferably is pre-heated in a preheater component (not shown) prior to introduction to the burner region 14.

The exhaust gases which are formed by the combustion process in engine 12 flow away from burner region 14 in exhaust gas stream 22 (shown as double arrows in the Figures). A substantial amount of the heat values in the exhaust gas stream 22 are transferred to heater tubes 24 which connect the working chambers 26 of the engine cylinders which are disposed in the engine heater head 28. Additional heat values are extracted from exhaust gas stream 22 in the preheater (not shown), which values are used to preheat the inlet air stream 20.

The recirculation apparatus 10 of the present invention to be described in greater detail henceforth, may be used with Stirling engines whose components and operation are conventional and well-known to those skilled in the art. However, the present invention is not meant to be limited to Stirling cycle or hot-gas engines applications by the present description as it may have other applications.

In accordance with the invention as embodied and broadly described herein, recirculation apparatus 10 includes wall means for separating the inlet air stream from the burner region and exhaust gas stream. Preferably, and with particular reference to FIGS. 1 and 2, the wall means 30 includes a first wall 32 separating the inlet air stream 20 from exhaust gas stream 22 and a second wall 34 separating the exhaust gas stream 22 from burner region 14. It is understood that flow passages (not shown) are provided in second wall 34 in the vicinity of heater tubes 24 to allow exhaust gas stream 22 to exit the burner region 14 after transferring heat values to tubes 24.

In accordance with the invention, as broadly described herein, the recirculation apparatus 10 also includes ejector means formed in the wall means. With continued reference to FIGS. 1 and 2, there is shown a preferred ejector means 36 formed in wall means 30. The purpose of ejector means 36 is to admit the inlet air stream 20 into the burner region 14 while entraining and mixing a portion of the exhaust gases from exhaust gas stream 22 with the air being admitted. The resultant air/exhaust gas mixture exiting ejector means 36 into the burner region 14 accomplishes the desired reduction in combustion temperatures and $NO_x$ formation.

As embodied herein, ejector means 36 comprises an inlet nozzle means 38, outlet nozzle means 40 and a suction inlet means 42. Preferably, ejector means 36 includes a plurality of individual ejectors 37, and inlet nozzle means 38 and outlet nozzle means 40 include a plurality of individual inlet nozzles 46 and associated outlet nozzles 48, respectively. The individual ones of inlet nozzles 46 are generally pipe shaped and have an inlet end 50 terminating at first wall 32 and the discharge end 52 directed toward the fuel nozzle 18. The inlet ends 50 can be bell-shaped to improve the entrance flow characteristics of inlet air streams 20.

Individual ones of outlet nozzles 48 also are generally pipe-shaped each having an inlet end 54 and a discharge end 56. Each one of the outlet ends 56 terminates at second wall 34 and is directed toward burner region 14. The individual inlet ends 54 of outlet nozzles 48 are positioned to receive the discharge from inlet nozzle discharge ends 52 of the associated inlet nozzzle 46. The individual outlet nozzles 48 are positioned co-axially with, and have a greater cross-sectional flow area than the associated inlet nozzle 46. The increased cross-sectional flow area compensates for the increased volumetric gas flow exiting the ejector means (air plus exhaust gas) relative to the air flow through the inlet nozzles 46 and the decreased flow velocities in the outlet nozzles 48.

Portions 44 (shown as triple arrows) of gas stream 22 enter the individual ejectors 37 at the gaps 58 between the inlet nozzle discharge ends 52 and the associated outlet nozzle inlet ends 54, and thus gaps 58 constitute a plurality of suction inlets. By virtue of the velocity of the air exiting the inlet nozzle discharge ends 52 and transferring momentum to the gaseous material in the outlet nozzles 48, a low pressure is formed in the vicinity of gaps 58 relative to the pressure in exhaust gas stream 22, resulting in the flow of portions 44 of the exhaust gas stream 22 into the ejectors 37. Outlet nozzle inlet ends 54 can be positioned to slightly overlap the respective inlet nozzle ends 52 to improve ejector performance. Also, the outlet nozzle inlet ends 54 can be flared into a bell shape to improve suction inlet flow characteristics.

Figure 2:
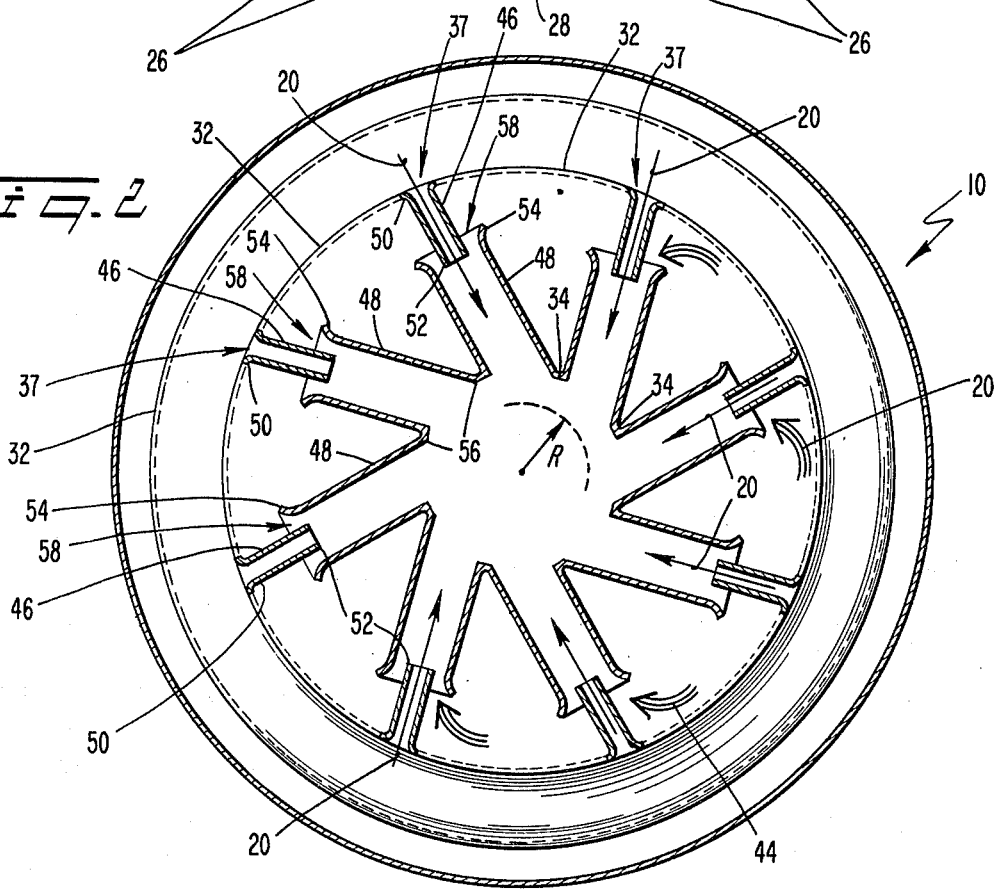
FIG. 2 is a top view of the embodiment shown in FIG. 1 taken along the line II—II.

Preferably, when burner region 14 is cylindrical with the fuel being admitted axially, such as by fuel nozzle 18 as is shown in FIGS. 1 and 2, individual ejectors 37 are spaced circumferentially around the burner region 14 with the axes of the individual ejectors 37 directed toward the burner region 14. The axes of individual ejectors 37 are coplanar and oriented eccentrically to the axis of the burner region 14, such as substantially tangential to a circle designated R in FIG. 2, where R is less than the radius of the burner region. The tangential admittance of the air/exhaust gas mixture induces swirling to provide better mixing with the fuel and thereby increases combustion efficiency.

Figure 3:
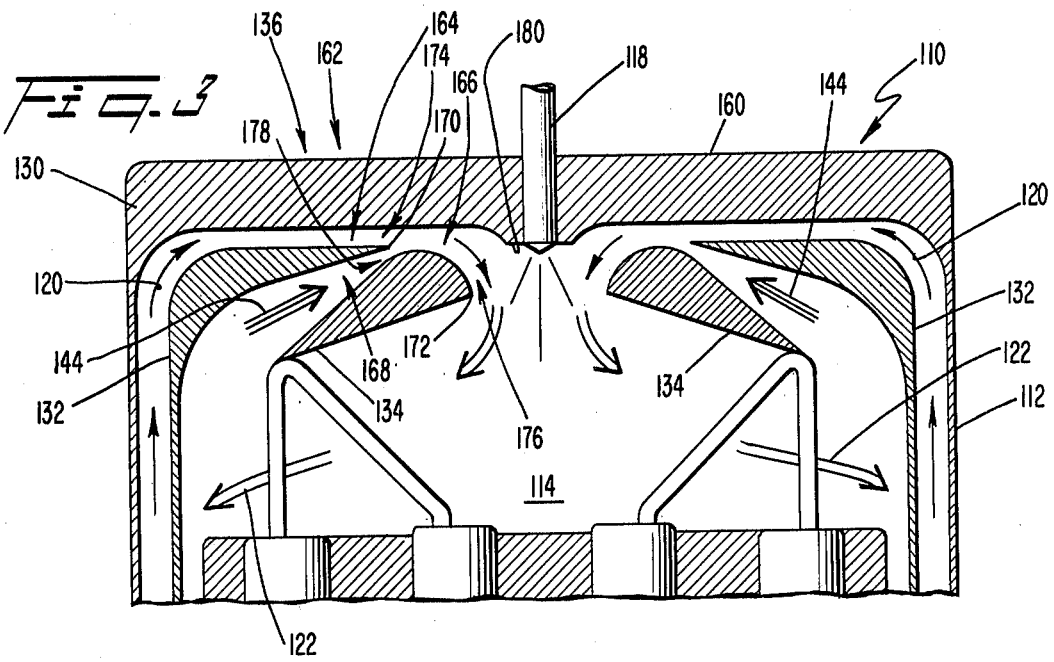
FIG. 3 is a cross-sectional side view of another embodiment of the present invention.

An alternative embodiment of the invention, as depicted in FIG. 3, also is shown in use with a burner region 114 of generally cylindrical shape, with axially admitted fuel such as by fuel nozzle 118. The individual components of the Stirling hot-gas engine that are shown in FIG. 3 with 100-series numbers are similar in operation and function to those discussed in relation to the embodiment depicted in FIGS. 1 and 2 using the 10-series numbers. Only the details of the recirculation apparatus 110 will be discussed henceforth.

In accordance with the invention, recirculation apparatus 110 comprises wall means 130, including first wall 132 and second wall 134, and ejector means 136. Similar to the corresponding components (10-series numbers) in the embodiment in FIGS. 1 and 2, first wall 132 separates inlet air stream 120 from exhaust gas stream 122, and second wall 134 separates exhaust gas stream 122 from burner region 114. As embodied herein, wall means 130 also includes a third wall 160 positioned outside first wall 132 and enclosing the axial end of burner region 114. First wall 132 and second wall 134 are spaced from third wall 160 and from one another. Fuel nozzle 118 penetrates the third wall 160 at approximately the axis of the burner region 114.

As embodied herein, ejector means 136 comprises a single ejector 162 having an inlet nozzle 164, an outlet nozzle 166, and a suction inlet 168. First wall 132 and second wall 134 partially enclose the axial end of burner region 114 except for apertures in the vicinity of fuel nozzle 118. Apertures defined by edges 170 of first wall 132 and by edge 172 of second wall 134 expose fuel nozzle 118 to burner region 114. Both the first wall aperture and second wall aperture preferably are circular and concentric with the fuel nozzle 118.

Inlet nozzle 164 is disk-shaped and formed by the spacing between the axial end portion of third wall 160 and first wall 132. Discharge from inlet nozzle 164 flows through the annular gap 174 between third wall 160 and edge 170. Outlet nozzle 166 also is generally disk-shaped and is formed by the spacing between the end portions of third wall 160 and second wall 134.

Outlet nozzle 166 intercepts the flow from inlet nozzle 164 which emanates through annular gap 174. Outlet nozzle 166 discharges to the burner region 114 through annular gap 176 which is defined by edge 172 of second wall 134 and proximate portion of third wall 160. Suction inlet 168 of ejector 162 includes the annular gap 178 formed by edge 170 of the aperture in first wall 132 and the proximate part of the second wall 134.

In operation, the flow of inlet air stream 120 through annular gap 174 causes entrainment of a portion 144 of the exhaust gas from exhaust gas stream 122. The resultant mixture of inlet air/exhaust gas flows to burner region 114 through annular gap 176. Again, to achieve optimum flow characteristics and to minimize hydraulic flow losses, configuration of third wall 160 and second wall 134 in the vicinity of annular gap 176 can be tailored to enhance mixing with the incoming fuel from fuel nozzle 118. As is shown in FIG. 3, the outlet region of outlet nozzle 166 at gap 176 is bell-shaped to act as a diffuser and increase flow efficiency. Also, annular ridge 180 is provided on third wall 160 surrounding fuel nozzle 118 to turn the generally radially-directed flow into the axial direction, toward burner region 114.

Figure 4:
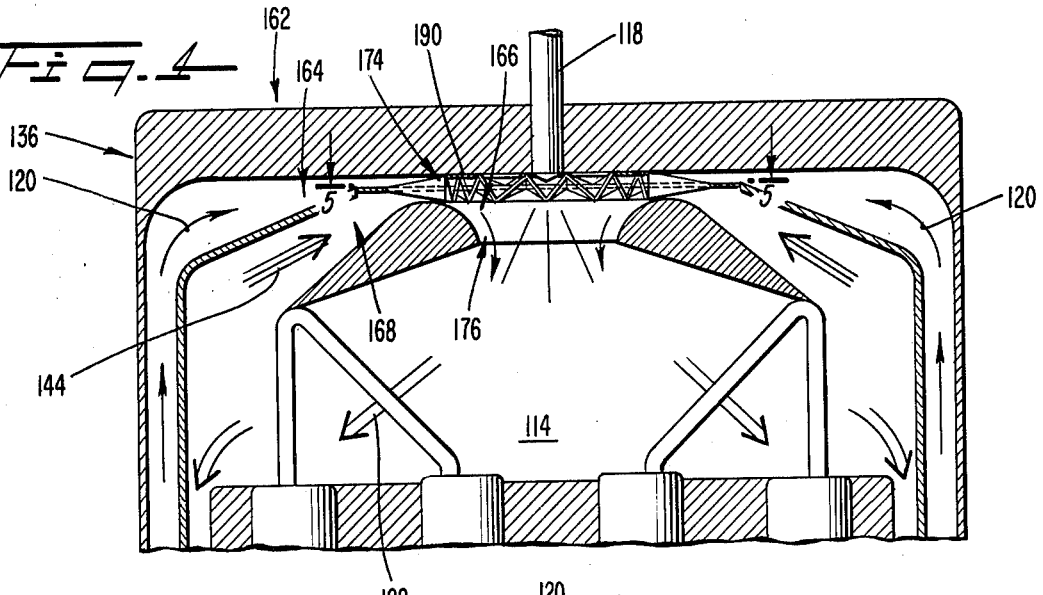
FIG. 4 is a cross-sectional side view of a variation of the embodiment of the present invention as shown in FIG. 3.

Preferably, and as best seen in FIG. 4, ejector means 136 also includes a flow distribution means, such as annular flow distribution plate 190. Flow distribution plate 190 cooperates with inlet nozzle 164 and suction inlet 168 of ejector 162 to provide an even distribution of inlet air and exhaust gases to the annular outlet nozzle 166 and thus, an even distribution of the air/exhaust gas mixture to the burner region 114.

Figure 6:
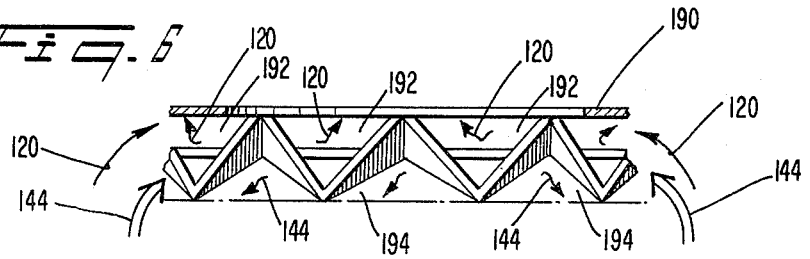
FIGS. 5 and 6 are other views of a schematic representation of one component of the apparatus shown in FIG. 4.
Figure 5:
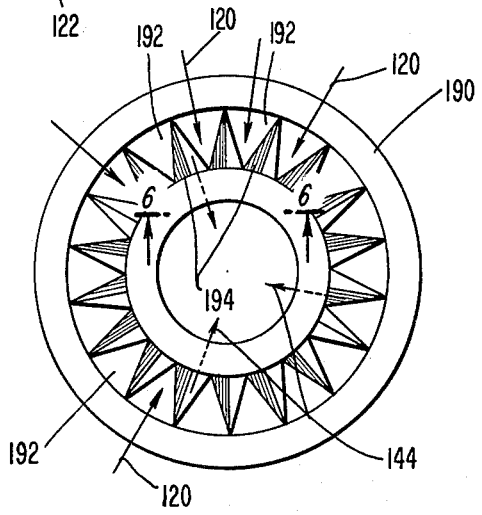

Referring to FIGS. 5 and 6, flow distribution plate 190 has two series of radially-directed flow passages 192 and 194 positioned on the top and bottom sides of plate 190, respectively. Plate 190 is positioned relative to inlet nozzle 164 and suction inlet 168 to allow passages 192 to intercept and channel inlet air flow from gap 174 to inlet nozzle 164, and passages 194 to intercept and channel exhaust gas flow 144 from suction inlet 168 through gap 178. Both series of passages 192 and 194 direct the respective flows toward the annular outlet nozzle 166.

Configuration of flow distribution plate 190 is preferably tailored to enhance the ejector effect of single ejector 162. Thus, the cross-sectional flow areas of passages 192 decrease in the direction of inward radial flow to increase the inlet air velocity incident on the outlet nozzle 166, while the flow area for the passages 194 increases in the inward radial direction to provide decreased exhaust gas flow resistance.

The flow distribution plate 190 can be conveniently fabricated using conventional metal pressing or stamping techniques. A suitable plate is one that is radially corrugated with the passages 192 and 194 alternating in position in the circumferential direction. The choice of particular sheet metal material used for the flow distribution plate 190, of course, will depend upon the particular application considered, including temperatures, compatibility with fuel types and exhaust gas corrosion characteristics, etc. and can be selected using criteria well-known to those skilled in the design of combustion devices.

During operations of a combustion device including recirculation apparatus constructed according to the present invention, the maximum temperature of the combustion gases in the burner region may be about 1,700° C. The temperature of the combustion gases may be lowered to about 750° C. after the gases have passed the heater tubes. The temperature of the inlet air may be about 700° C. after being pre-heated and the temperature of the mixture of air and recirculated combustion gases in the ejectors may be about 720° C. The amount of $NO_x$ in the combustion gases leaving the preheater may be as low as about 50 ppm.

It will be apparent to those skilled in the art that various modifications and variations can be made in the recirculation apparatus of the present invention without departing from the scope and spirit of the invention. Thus, it is intended that the present invention cover the modifications and variations of this invention provided they come within the scope of the appended claims and their equivalents.

What is claimed is:

1. Apparatus for recirculating a portion of the exhaust gases from an exhaust gas stream resulting from the combustion of an inlet fuel stream and an inlet air stream in a burner region, the apparatus comprising:

(a) wall means for separating the inlet air stream from the burner region and the exhaust gas stream;

(b) heat exchanger means associated with said wall means for extracting heat values from the exhaust gas stream to cool all the exhaust gases, said heat exchanger means also enclosing in part the burner region; and (c) ejector means formed in said wall means for admitting the inlet air stream into the burner region and for entraining and mixing a portion of the cooled exhaust gases from the cooled exhaust gas stream in the air being admitted, and air/cooled exhaust gas mixture being formed immediately prior to being admitted to the burner region, the recirculated exhaust gases providing lower combustion temperatures and reduced $NO_x$ formation in the burner region.

2. Apparatus as in claim 1 wherein the inlet air stream is preheated by the remainder portion of the cooled exhaust gas stream upstream of said ejector means.

3. Apparatus for recirculating a portion of the exhaust gases from an exhaust gas stream resulting from the combustion of an inlet fuel stream and an inlet air stream in a burner region, the apparatus comprising:

(a) wall means for separating the inlet air stream from the burner region and the exhaust gas stream;

(b) heat exchanger means associated with said wall means for extracting heat values from the exhaust gas stream to cool all the exhaust gases, said heat exchanger means also enclosing in part the burner region; and (c) ejector means formed in said wall means for admitting the inlet air stream into the burner region and for entraining and mixing a portion of the cooled exhaust gases from the cooled exhaust gas stream in the air being admitted, said air/cooled exhaust gas mixture being formed immediately prior to being admitted to the burner region, the recirculated exhaust gases providing lower combustion temperatures and reduced $NO_x$ formation in the burner region, said apparatus for use in a hot-gas engine of the Stirling cycle-type wherein said ejector means is positioned above a hot-gas engine heater head, said head to be heated by the heat values extracted from the exhaust gases by the heat exchanger means.

4. Apparatus for recirculating a portion of the exhaust gases from an exhaust gas stream resulting from the combustion of an inlet fuel stream and an inlet air stream in a burner region, the apparatus comprising:

(a) wall means for separating the inlet air stream from the burner region and the exhaust gas stream;

(b) heat exchanger means associated with said wall means for extracting heat values from the exhaust gas stream to cool all the exhaust gases, said heat exchanger means also enclosing in part the burner region; and (c) ejector means formed in said wall means for admitting the inlet air stream into the burner region and for entraining and mixing a portion of the cooled exhaust gases from the cooled exhaust gas stream in the air being admitted, said air/cooled exhaust gas mixture being formed immediately prior to being admitted to the burner region, the recirculated exhaust gases providing lower combustion temperatures and reduced $NO_x$ formation in the burner region, said wall means further including (1) a first wall separating the inlet air stream from the exhaust gas stream and the burner region, and (2) a second wall separating the cooled exhaust gas stream from the burner region, said heat exchanger means forming part of said second wall; and wherein said ejector means includes (i) inlet nozzle means in flow communication with the inlet air stream, (iii) outlet nozzle means in flow communication with the burner region, and (iii) suction inlet means in flow communication with the cooled exhaust gas stream and cooperating with said inlet nozzle means and said outlet nozzle means, said inlet nozzle means being formed in said first wall, and said outlet nozzle means formed in said second wall.

5. Apparatus for recirculating a portion of the exhaust gases from an exhaust gas stream resulting from the combustion of an inlet fuel stream and an inlet air stream in a burner region, the apparatus comprising:

(a) wall means for separating the inlet air stream from the burner region and the exhaust gas stream; and (b) ejector means formed in said wall means for admitting the inlet air stream into the burner region and for entraining and mixing a portion of the exhaust gases from the exhaust gas stream in the air being admitted, said air/exhaust gas mixture being formed immediately prior to being admitted to the burner region, the recirculated exhaust gases providing lower combustion temperatures and reduced $NO_x$ formation in the burner region, said wall means further including (1) a first wall separating the inlet air stream from the exhaust gas stream and the burner region, and (2) a second wall separating the exhaust gas stream from the burner region; and wherein said ejector means includes (i) inlet nozzle means in flow communication with the inlet air stream, (ii) outlet nozzle means in flow communication with the burner region, and (iii) suction inlet means in flow communication with the exhaust gas stream and cooperating with said inlet nozzle means and said outlet nozzle means, said inlet nozzle means being formed in said first wall, and said outlet nozzle means formed in said second wall, wherein said ejector means includes a plurality of ejectors, and said inlet nozzle means includes a plurality of individual inlet nozzles formed in said first wall, the axes of said inlet nozzles being directed toward the burner region.

6. Apparatus as in claim 5 wherein each of said individual inlet nozzles is pipe-shaped and has an inlet end and a discharge end, the inlet end of each of said pipe-shaped nozzles terminating at said first wall.

7. Apparatus as in claim 5 wherein the burner region is cylindrical and the fuel is introduced axially to the burner region from the fuel stream, said plurality of inlet nozzles being spaced around the periphery of the burner region, and the discharge end of each of said inlet nozzles being directed inwardly.

8. Apparatus as in claim 5 wherein said suction inlet means includes a plurality of individual suction inlets, each one of said individual suction inlets being associated with a particular one of said plurality of inlet nozzles, each individual suction inlet being positioned proximate the discharge end of said respective inlet nozzle.

9. Apparatus as in claim 5 wherein said outlet nozzle means includes a plurality of individual outlet nozzles formed in said second wall, each of said outlet nozzles being positioned co-axially with a respective inlet nozzle for receiving inlet air flow from said respective inlet nozzle, the interaction between the flow of inlet air from each of said inlet nozzles to the respective one of said outlet nozzles causing a portion of the exhaust gas stream to flow through said suction inlet means and becoming mixed with the inlet air stream in said outlet nozzles, the cross-sectional flow area of each of said outlet nozzles being greater than that of the respective one of said inlet nozzles.

10. Apparatus as in claim 9 wherein each of said individual outlet nozzles is pipe-shaped and has an inlet end and a discharge end, the discharge end of each of said outlet nozzles terminating at said second wall.

11. Apparatus as in claim 9 wherein each of said outlet nozzles partially overlaps the respective inlet nozzle and the inlet end of each of said outlet nozzles is positioned short of said first wall, said suction nozzle means including gaps between the inlet ends of said outlet nozzles and the proximate portions of the respective inlet nozzles.

12. Apparatus as in claim 11 wherein the inlet ends of each of said outlet nozzles is flared outward.

13. Apparatus as in claim 9 wherein said burner region is cylindrical and fuel is admitted axially to the burner region from the fuel stream through fuel nozzle means, the axes of said plurality of outlet nozzles being coplanar and spaced around the periphery of the burner region, each outlet nozzle being directed inwardly toward said fuel nozzle means and eccentrically oriented for admitting the inlet air/exhaust gas mixture tangentially into the burner region for inducing swirling in the burner region and providing enhanced mixing of the fuel and inlet air/exhaust gas mixture.

14. Apparatus for recirculating a portion of the exhaust gases from an exhaust gas stream resulting from the combustion of an inlet fuel stream and an inlet air stream in a burner region, the apparatus comprising:

(a) wall means for separating the inlet air stream from the burner region and the exhaust gas stream; and (b) ejector means formed in said wall means for admitting the inlet air stream into the burner region and for entraining and mixing a portion of the exhaust gases from the exhaust gas stream in the air being admitted, said air/exhaust gas mixture being formed immediately prior to being admitted to the burner region, the recirculated exhaust gases providing lower combustion temperatures and reduced $NO_x$ formation in the burner region, said wall means further including (1) a first wall separating the inlet air stream from the exhaust gas stream and the burner region, and (2) a second wall separating the exhaust gas stream from the burner region; and wherein said ejector means includes (i) inlet nozzle means in flow communication with the inlet air stream, (ii) outlet nozzle means in flow communication with the burner region, and (iii) suction inlet means in flow communication with the exhaust gas stream and cooperating with said inlet nozzle means and said outlet nozzle means, said inlet nozzle means being formed in said first wall, and said outlet nozzle means formed in said second wall, the burner region being cylindrical and fuel being admitted to the burner region at one axial end from the inlet fuel stream through fuel nozzle means, said wall means further including a third wall positioned to enclose the end of the burner region, the fuel nozzle means penetrating said third wall, said second wall partially enclosing the end of the burner region and being spaced from said third wall, said ejector means including an aperture in said second wall for exposing said third wall and said fuel nozzle means to the burner region, said outlet nozzle means including the annular gap formed between said second wall and said third wall at the edge of said aperture, and wherein said first wall also partially encloses the burner region end and is positioned between, and spaced from, said second wall and said third wall, said ejector means further including an aperture formed in said first wall for exposing said third wall to said second wall, said inlet nozzle means including the annular gap formed between said first wall and said third wall at the edge of said first wall aperture.

15. Apparatus as in claim 14 wherein said first wall aperture also exposes said third wall and said fuel nozzle means to the burner region through said second wall aperture, said first wall aperture being larger than said second wall aperture.

16. Apparatus as in claim 15 wherein both said first wall aperture and said second wall aperture are circular and concentric with said fuel nozzle means, the radius of said first wall aperture being greater than the radius of said second wall aperture.

17. Apparatus as in claim 15 wherein said suction inlet means includes the gap formed between said first wall and the proximate portions of said second wall at the edge of said first wall aperture.

18. Apparatus for recirculating a portion of the exhaust gases from an exhaust gas stream resulting from the combustion of an inlet fuel stream and an inlet air stream in a burner region, the burner region being cylindrical and the fuel streams being admitted axially to the burner region through a fuel nozzle means, the apparatus comprising wall means for separating the inlet air stream from the burner region and the exhaust gas stream; and ejector means formed in said wall means for admitting the inlet air stream into the burner region and for entraining and mixing a portion of the exhaust gases from the exhaust gas stream in the air being admitted, said air/exhaust gas mixture being formed immediately prior to being admitted to the burner region, the recirculated exhaust gases providing lower combustion temperatures and reduced $NO_x$ formation in the burner region, said wall means including a first wall separating the inlet air stream from the exhaust gas stream and the burner region, and a second wall separating the exhaust gas stream from the burner region; and said ejector means including inlet nozzle means in flow communication with the inlet air stream, outlet nozzle means in flow communication with the burner region, and suction inlet means in flow communication with the exhaust gas stream and cooperating with said inlet nozzle means and said outlet nozzle means, said inlet nozzle means being formed in said first wall, and said outlet nozzle means formed in said second wall, said ejector means also including a plurality of ejectors, said inlet nozzle means including a plurality of individual inlet nozzles formed in said first wall, the axes of said inlet nozzles being directed toward the burner region, and said outlet nozzle means including a plurality of individual outlet nozzles formed in said second wall, each of said outlet nozzles being positioned co-axially with a respective inlet nozzle for receiving inlet air flow from said respective inlet nozzle, the interaction between the flow of inlet air from each of said inlet nozzles to the respective one of said outlet nozzles causing a portion of the exhaust gas stream to flow through said suction inlet means and becoming mixed with the inlet air stream in said outlet nozzles, the cross-sectional flow area of each of said outlet nozzles being greater than that of the respective one of said inlet nozzles, the axes of said plurality of outlet nozzles being coplanar and spaced around the periphery of the burner region, each outlet nozzle being directed inwardly toward said fuel nozzle means and eccentrically oriented for admitting the inlet air/exhaust gas mixture tangentially into the burner region for inducing swirling in the burner region and providing enhanced mixing of the fuel and inlet air/exhaust gas mixture.

19. Apparatus for recirculating a portion of the exhaust gases from an exhaust gas stream resulting from the combustion of an inlet fuel stream and an inlet air stream in a burner region, the burner region being cylindrical and the inlet fuel stream being admitted at one axial and through fuel nozzle means, the apparatus comprising wall means for separating the inlet air stream from the burner region and the exhaust gas stream; and ejector means formed in said wall means for admitting the inlet air stream into the burner region and for entraining and mixing a portion of the exhaust gases from the exhaust gas stream in the air being admitted, said air/exhaust gas mixture being formed immediately prior to being admitted to the burner region, the recirculated exhaust gases providing lower combustion temperatures and reduced $NO_x$ formation in the burner region, said wall means including a first wall separating the inlet air stream from the exhaust gas stream and the burner region, and a second wall separating the exhaust gas stream from the burner region; and said ejector means including inlet nozzle means in flow communication with the inlet air stream; outlet nozzle means in flow communication with the burner region, and suction inlet means in flow communication with the exhaust gas stream and cooperating with said inlet nozzle means and said outlet nozzle means, said inlet nozzle means being formed in said first wall, and said outlet nozzle means formed in said second wall, said wall means further including a third wall positioned to enclose the end of the burner region, the fuel nozzle means penetrating said third wall, said second wall partially enclosing the end of the burner region and being spaced from said third wall, said ejector means including an aperture in said second wall for exposing said third wall and said third wall and said fuel nozzle means to the burner region, said outlet nozzle means including the annular gap formed between said second wall and said third wall at the edge of said aperture, and wherein said first wall partially encloses the burner region end and is positioned between, and spaced from, said second wall and said third wall, said ejector means further including an aperture formed in said first wall for exposing said third wall to said second wall, said inlet nozzle means including the annular gap formed between said first wall and said third wall at the edge of said first wall aperture, said ejector means further including a flow distribution means cooperating with said inlet nozzle means, said suction inlet means, and said outlet nozzle means.

20. Apparatus as in claim 19 wherein said flow distribution means includes an annular plate having a first series of radially-directed flow passages on one plate side and a second series of radially-directed flow passages on the other side of said plate, said plate being positioned upstream of said outlet nozzle gap, said first series of passages intercepting and channeling toward said outlet nozzle gap the inlet air flowing through said inlet nozzle means and said second series of passages intercepting and channeling toward said outlet nozzle gap the exhaust gas flowing through said suction inlet means.

21. Apparatus as in claim 20 wherein the cross-sectional flow area of each of the passages in said first series decreases toward the inner radius of the annular plate, and wherein the cross-sectional flow area for each of the passages in said second series increases toward the inner plate radius.

22. Apparatus as in claim 20 wherein said annular flow distribution plate is a radially-corrugated pressed metal disk.

* * * * *